US009237397B2

(12) United States Patent
Wang

(10) Patent No.: US 9,237,397 B2
(45) Date of Patent: Jan. 12, 2016

(54) TUNABLE EARPHONE

(71) Applicant: TAER INNOVATION CO., LTD., New Taipei (TW)

(72) Inventor: Chih-Sheng Wang, New Taipei (TW)

(73) Assignee: TAER INNOVATION CO., LTD., New Taipei (TW)

( * ) Notice: Subject to any disclaimer, the term of this patent is extended or adjusted under 35 U.S.C. 154(b) by 0 days.

(21) Appl. No.: 14/624,676

(22) Filed: Feb. 18, 2015

(65) Prior Publication Data

US 2015/0237436 A1 Aug. 20, 2015

(30) Foreign Application Priority Data

Feb. 19, 2014 (TW) ..... 103105477 A

(51) Int. Cl.
*H04R 25/00* (2006.01)
*H04R 1/10* (2006.01)

(52) U.S. Cl.
CPC ..... *H04R 1/1041* (2013.01); *H04R 1/1058* (2013.01)

(58) Field of Classification Search
CPC ..... H04R 1/1041; H04R 1/1058
USPC ..... 379/430; 381/370–374, 376–380; 455/575.2
See application file for complete search history.

(56) References Cited

U.S. PATENT DOCUMENTS

| | | | | |
|---|---|---|---|---|
| 6,826,287 | B2 * | 11/2004 | Myers | 381/373 |
| 2012/0114160 | A1 * | 5/2012 | Lin | 381/380 |
| 2014/0226847 | A1 * | 8/2014 | Yang | 381/380 |
| 2014/0286521 | A1 * | 9/2014 | Yang | 381/380 |

* cited by examiner

*Primary Examiner* — Tuan D Nguyen
(74) *Attorney, Agent, or Firm* — Li & Cai Intellectual Property (USA) Office

(57) ABSTRACT

A tunable earphone is provided. By moving a tuning rod inserted into a hollow shell with a varied depth to drive a tuning plate thus changing the distance between a speaker and the tuning plate, the air in the hollow shell can resonate for different volumes and different path lengths, thereby adjusting a frequency response characteristic of the whole earphone.

6 Claims, 3 Drawing Sheets

TUNABLE EARPHONE

TECHNICAL FIELD

The present disclosure relates to a tunable earphone, and in particular, to a tunable earphone for tuning by moving a tuning rod to drive a tuning piece to be translated.

BACKGROUND ART

Generally, the tone-quality performance of an earphone in the market is fixed, that is, the tone color and frequency response characteristic of the earphone is decided when leaving the factory. As a result, after purchasing an earphone, a user can at most adjust the playing device, and cannot adjust the earphone.

However, the adjustment of the playing device is only a digital correction and cannot satisfy a consumer pursuing high tone-quality performance. Furthermore, not all playing devices used by consumers have the tuning function. Therefore, a consumer may possibly need to purchase many different earphones to experience different tone quality characteristics, resulting in increased consumption cost and inconvenience in use.

SUMMARY OF THE INVENTION

The present disclosure provides a tunable earphone, which can tune through inward and outward movement of a tuning rod and a tuning piece.

The tunable earphone of the present disclosure comprises a front shell; a back shell, where the front shell and the back shell are tightly joined to form a hollow shell and the hollow shell has a front end hole and a back end hole; a speaker, disposed in the hollow shell; a tuning rod, movably inserted into the hollow shell from the back end hole; a tuning plate, fixed at an end of the tuning rod inserted into the hollow shell; and a sealing ring, disposed between the tuning rod and an inner wall of the hollow shell to prevent air in the hollow shell from entering and exiting from the back end hole, wherein the air resonating effect in the hollow shell is adjusted by moving the tuning rod to drive the tuning plate thus changing the distance between the speaker and the tuning plate.

According to a preferred embodiment of the present disclosure, the tuning rod may further have an outer thread, the back end hole may further have a back end hole thread, and the tuning rod may move front and back in the back end hole with the outer thread and the back end hole thread.

According to a preferred embodiment of the present disclosure, the tuning rod may further have an inner thread, the tunable earphone further comprises a retaining screw, and the retaining screw may lock the tuning plate at an end of the tuning rod inserted into the hollow shell with the inner thread.

According to a preferred embodiment of the present disclosure, the tunable earphone may further comprise an earplug, annularly arranged around the exterior of the front end hole.

According to a preferred embodiment of the present disclosure, the tuning plate may have a plurality of holes.

According to a preferred embodiment of the present disclosure, the tuning plate is circular, elliptical, polygonal, or irregularly shaped.

With the foregoing method, the tunable earphone of the present disclosure may adjust the frequency response characteristic of the whole earphone by moving the tuning rod inserted into the hollow shell to drive the tuning plate with a varied depth thus changing the distance between the speaker and the tuning plate so that the air in the hollow shell can resonate for different volumes and different path lengths.

In order to further understand the technology, method and effect adopted by the present disclosure, reference is made to the detailed description of the preferred embodiments and drawings relevant to the present disclosure. It is believed that the features and characteristics of the present disclosure can be understood thoroughly and specifically therewith. However, the accompanying drawings and appendix are intended for reference and illustration purposes only, not to limit the present disclosure.

DETAILED DESCRIPTION OF THE PREFERRED EMBODIMENTS

A tunable earphone of the present disclosure will be explained below through embodiments. It should be noted that the embodiments of the present disclosure are not intended to limit the present disclosure to be implemented in any specific environment, application or special manner as described below. Therefore, the description of the embodiments is only intended to explain the present disclosure, but not to limit the present disclosure.

Figure 1:
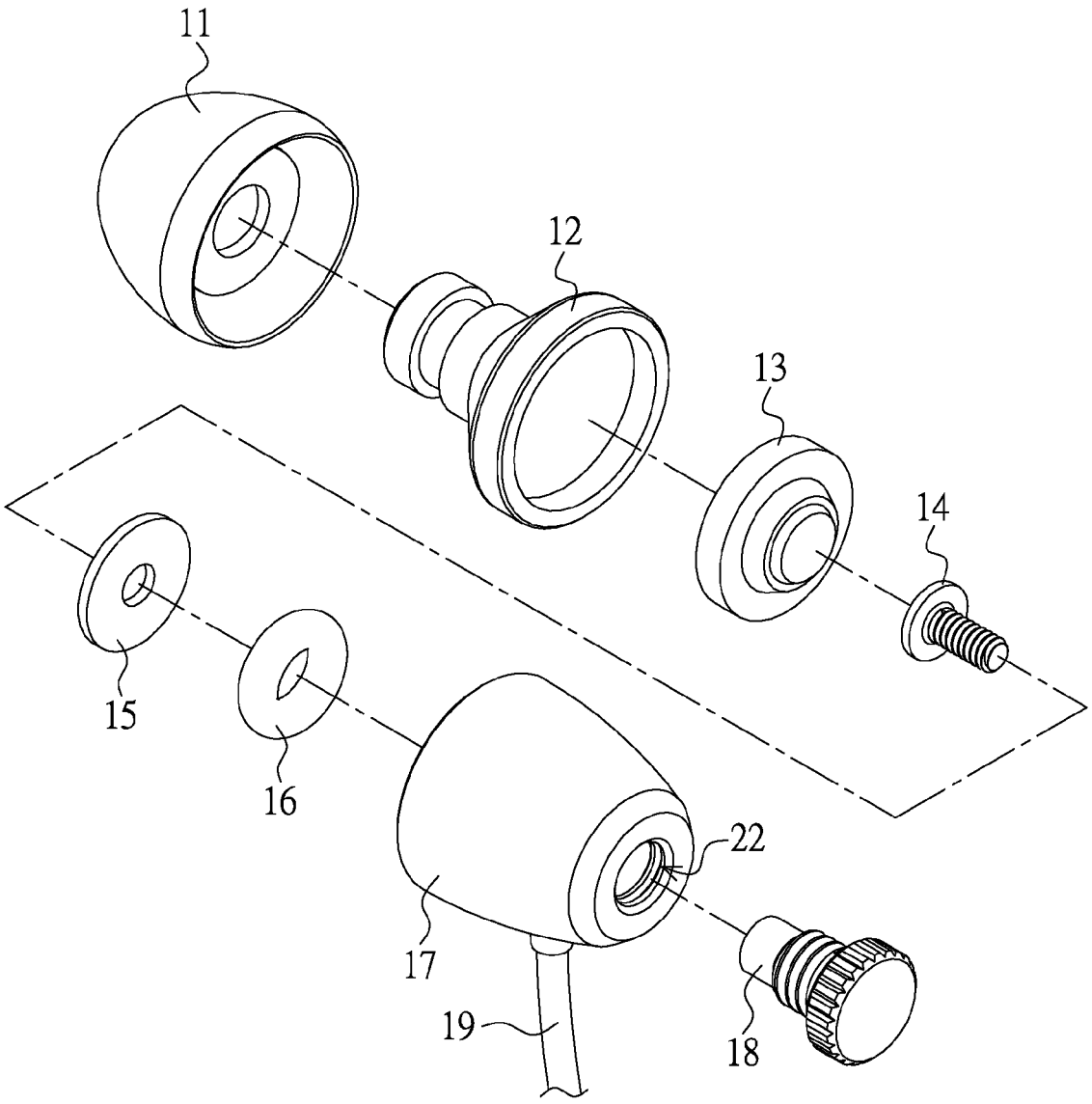
FIG. 1 is an exploded view of an embodiment of a tunable earphone of the present disclosure.

Referring to FIG. 1, an exploded view of an embodiment of a tunable earphone of the present disclosure is depicted. In such an embodiment, the tunable earphone of the present disclosure comprises an earplug 11, a front shell 12, a speaker 13, a retaining screw 14, a tuning plate 15, a sealing ring 16, a back shell 17, a tuning rod 18, and a transmission line 19.

Figure 2:
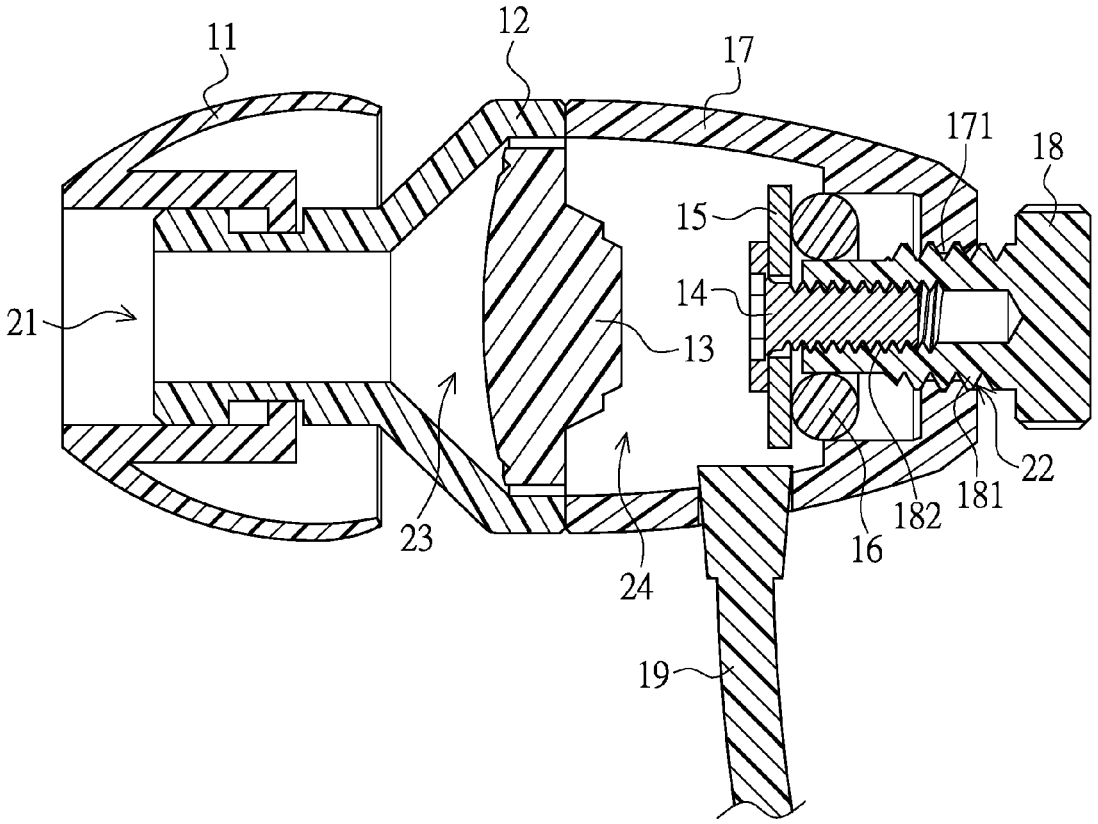
FIG. 2 is a cross-sectional view of an embodiment of a tunable earphone of the present disclosure.

Reference is made to FIG. 2 for a detailed component connection relationship. FIG. 2 is a cross-sectional view of an embodiment of a tunable earphone of the present disclosure. The front shell 13 and the back shell 17 are tightly joined to form a hollow shell. The hollow shell has a front end hole 21 and a back end hole 22. A central part of the hollow shell is generally divided by the speaker 13 into a voice box 23 and a resonating box 24. The sound from the speaker 13 can resonate with air in the space of the voice box 23 and the resonating box 24. The frequency response characteristic of the whole earphone can be determined according to the volume of the voice box 23 and the resonating box 24 and the distance from the speaker to inner walls of the two boxes. Simply, that is the reason why the earphone performs differently for a high audio frequency and a low audio frequency.

In this embodiment, the tuning rod 15 has an outer thread 181 and an inner thread 182 and the back end hole 22 has a back end hole thread 171, so that the tuning rod 15 can be screwed in or out after being inserted into the hollow shell from the back end hole 22. Furthermore, the inner thread 182 can match with the retaining screw 14 to fix the tuning plate 15 onto the tuning rod 15. As such, the screwing in or out of the tuning rod 18 drives the tuning plate 15 to move left or right in FIG. 2. In a preferred embodiment, the tuning piece 15 is of a material of wood, which may make the tone color thick. The material of the tuning piece 15 may also be plastic or rubber. The material of the retaining screw 14 is preferably consistent with that of the tuning piece. The material of the tuning rod 18 is preferably metal, but is not limited thereto.

In order to ensure air not to escape from the back end hole 22, the sealing ring 16 is disposed between the tuning rod 18 and an inner wall of the hollow shell and substantially blocks the space between the tuning rod 18 and the inner wall of the hollow shell. In a preferred embodiment, the sealing ring is of a material of silica gel or rubber to solidly prevent air within the hollow shell from entering and exiting from the back end hole 22.

The earplug 11 is arranged around the exterior of the front end hole 21 (that is, on the front shell 12), so that a user feels comfortable when the front end hole 21 is plugged into an ear of the user. Herein, a common earplug can be used and the material of the earplug is not specifically limited.

The transmission line 19 is used to integrate telecommunication transmission between the tunable earphone of the present disclosure and a playing device (not shown). A common transmission line can be used and the material of the transmission line is also not specifically limited as long as data transmission between the earphone and the playing device can be achieved.

Since a frequency response characteristic is relevant to the volume of the air resonating cavity and the path length, the tunable earphone of the present disclosure may adjust the frequency response characteristic of the whole earphone by moving the position of a tuning rod 18 inserted in the hollow shell to drive the tuning plate 15 thus changing the distance between the speaker 13 and the tuning plate 15 so that air in the hollow shell can resonate for different volumes and different path lengths. Furthermore, through application of such a principle, the tuning plate 15 of the present disclosure may also have a plurality of holes or the tuning plate 15 that are circular, elliptical, polygonal, or irregularly shaped, so as to change the path length for air to resonate, thereby adjusting the frequency response characteristic of the whole earphone.

Figure 3:
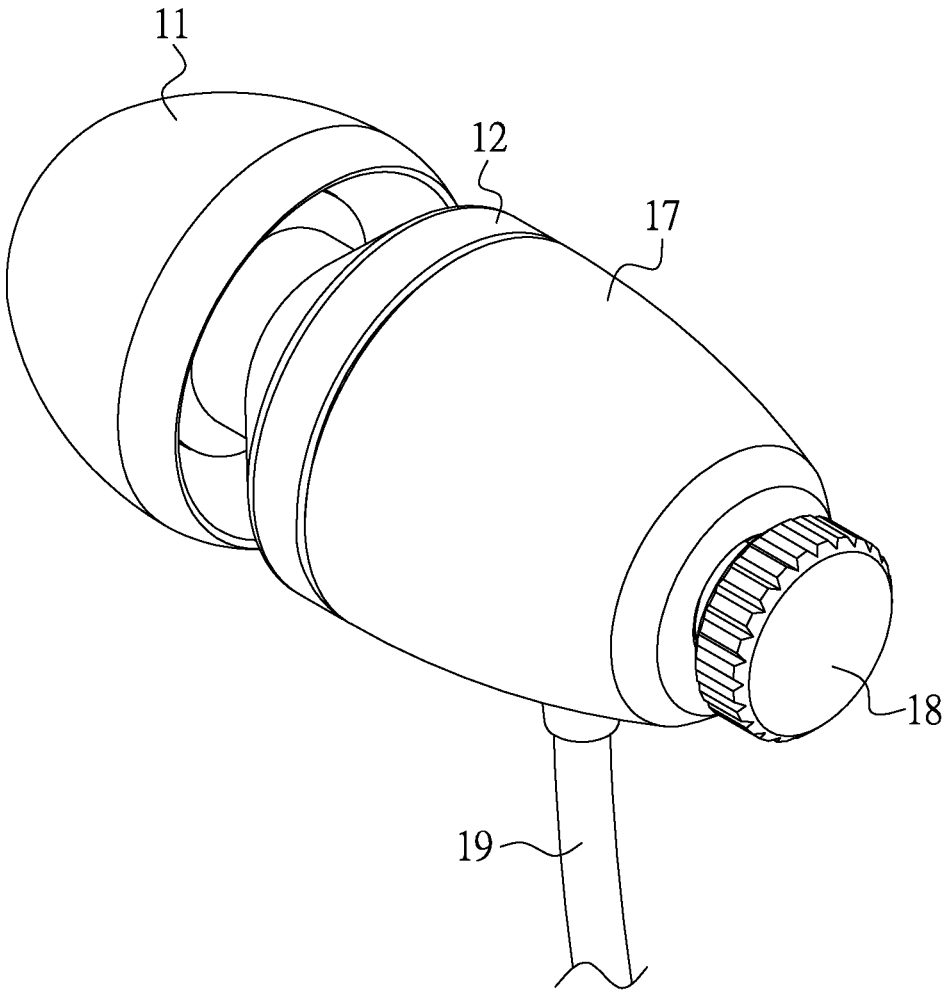
FIG. 3 is an assembled perspective view of an embodiment of a tunable earphone of the present disclosure.

In practice, reference may be made to FIG. 3. FIG. 3 is an assembled perspective view of an embodiment of a tunable earphone of the present disclosure. The earphone 11 is plugged into the ear of the user. The user can listen to the content from the earphone while adjusting the frequency response characteristic of the whole earphone simply by turning the tuning rod 18, so that the high or low audio performance of the currently played content can be adjusted in real time.

In this embodiment, the tuning rod itself has inner and outer threads, which are technical means for moving the tuning rod and fixing the tuning plate. However, the present invention is not limited thereto. The adopted technical means can be freely changed by those of ordinary skill in the art and are not limited to the threads as long as the technical means enables convenient moving of the tuning rod and stable fixation of the tuning plate onto the tuning rod.

Accordingly, compared with the conventional earphone, the tunable earphone of the present disclosure not only has a real-time tunable function but also generates an audio output of full, mellow, and undistorted tone quality. Therefore, on the premise of perfect tone-quality performance, the required high audio frequency or low audio frequency part can be reinforced to satisfy diverse requirements of the consumer.

The above description is merely intended to illustrate the embodiments of the present disclosure. All equivalent variations and modifications made according to the claims of the present disclosure fall within the scope of the present disclosure.

What is claimed is:

1. A tunable earphone, comprising:

a front shell;

a back shell, wherein the front shell and the back shell are tightly joined to form a hollow shell and the hollow shell has a front end hole and a back end hole;

a speaker, disposed in the hollow shell;

a tuning rod, movably inserted into the hollow shell from the back end hole;

a tuning plate, fixed at an end of the tuning rod inserted into the hollow shell; and a sealing ring, disposed between the tuning rod and an inner wall of the hollow shell to prevent air in the hollow shell from entering and exiting from the back end hole, wherein the distance between the speaker and the tuning plate is changed by moving the tuning rod to drive the tuning plate.

2. The tunable earphone according to claim 1, wherein the tuning rod further has an outer thread, the back end hole further has a back end hole thread, and the tuning rod moves front and back in the back end hole with the outer thread and the back end hole thread.

3. The tunable earphone according to claim 1, wherein the tuning rod further has an inner thread, the tunable earphone further comprises a retaining screw, and the retaining screw locks the tuning plate at an end of the tuning rod inserted into the hollow shell with the inner thread.

4. The tunable earphone according to claim 1, further comprising an earplug, wherein the earplug is annularly arranged around the exterior of the front end hole.

5. The tunable earphone according to claim 1, wherein the tuning plate has at least one hole.

6. The tunable earphone according to claim 1, wherein the tuning plate is circular, elliptical, polygonal, or irregularly shaped.

* * * * *